US008092408B2

(12) United States Patent
Sloan

(10) Patent No.: US 8,092,408 B2
(45) Date of Patent: Jan. 10, 2012

(54) MASSAGE DEVICE

(76) Inventor: Stewart E. Sloan, Omaha, NE (US)

( * ) Notice: Subject to any disclaimer, the term of this patent is extended or adjusted under 35 U.S.C. 154(b) by 959 days.

(21) Appl. No.: 12/079,268

(22) Filed: Mar. 26, 2008

(65) Prior Publication Data

US 2008/0200852 A1 Aug. 21, 2008

Related U.S. Application Data

(63) Continuation of application No. 10/827,032, filed on Apr. 19, 2004, now abandoned.

(51) Int. Cl.
*A61H 7/00* (2006.01)

(52) U.S. Cl. ..... 601/134; 601/135

(58) Field of Classification Search ..... 601/118, 601/119, 120–122, 128–129, 131–133, 135
See application file for complete search history.

(56) References Cited

U.S. PATENT DOCUMENTS

| | | | | |
|---|---|---|---|---|
| 4,867,451 | A | 9/1989 | Mitchell | |
| D356,354 | S | 3/1995 | Killion | |
| 5,577,996 | A * | 11/1996 | Gardner et al. | 601/120 |
| 5,597,159 | A | 1/1997 | Haygood et al. | |
| 5,868,689 | A * | 2/1999 | Faroky et al. | 601/120 |
| 6,062,993 | A | 5/2000 | Rodriguez | |
| 6,174,297 | B1 * | 1/2001 | Chen | 601/128 |
| 2005/0113726 | A1 * | 5/2005 | Prettyman | 601/119 |

* cited by examiner

*Primary Examiner* — Michael A. Brown
(74) *Attorney, Agent, or Firm* — Dennis L. Thomte; Thomte Patent Law Office LLC

(57) ABSTRACT

A massage device comprising an elongated flexible handle having a resilient ball movably secured to one end of the handle.

10 Claims, 1 Drawing Sheet

MASSAGE DEVICE

CROSS REFERENCE TO RELATED APPLICATION

This is a Continuation of application Ser. No. 10/827,032 filed Apr. 19, 2004 now abandoned, entitled MASSAGE DEVICE.

BACKGROUND OF THE INVENTION

1. Field of the Invention

This invention relates to a massage device and more particularly to a massage device which enables a person to massage an area of back or shoulder pain.

2. Description of the Related Art

Many times a person will experience a muscle spasm or back pain but is unable to reach the area of pain to massage the same. It is believed that prior to the instant invention, the prior art massage devices did not permit an individual to reach the area of pain to massage the same.

SUMMARY OF THE INVENTION

A massage device is described comprising an elongated flexible handle having first and second ends with a resilient ball secured to the second end of the handle. The ball is secured to the second end of the handle in such a way that permits the ball to move with respect to the handle. When a person experiences back or shoulder pain, the person grasps the handle and maneuvers the same to position the ball adjacent the area of pain. The person then leans back against the ball so that the ball is positioned between the person's back and the back of a chair or the like. The person then moves with respect to the chair back so that the ball will roll over the area of back pain, thereby massaging the same.

It is therefore a principal object of the invention to provide an improved massage device.

A further object of the invention is to provide a massage device which enables a person to massage an area of back or shoulder pain.

Yet another object of the invention is to provide a massage device which is easy to use.

Yet another object of the invention is to provide a massage device which may be positioned between a person's back and a chair so that the person may massage the area of back pain.

Yet another object of the invention is to provide a massage device of the type described which includes a flexible plastic handle and a resilient ball movably mounted at one end thereof.

Still another object of the invention is to provide a massage device of the type described which is easily carried within a briefcase, purse, etc.

These and other objects will be apparent to those skilled in the art.

DETAILED DESCRIPTION OF THE INVENTION

Figure 1:
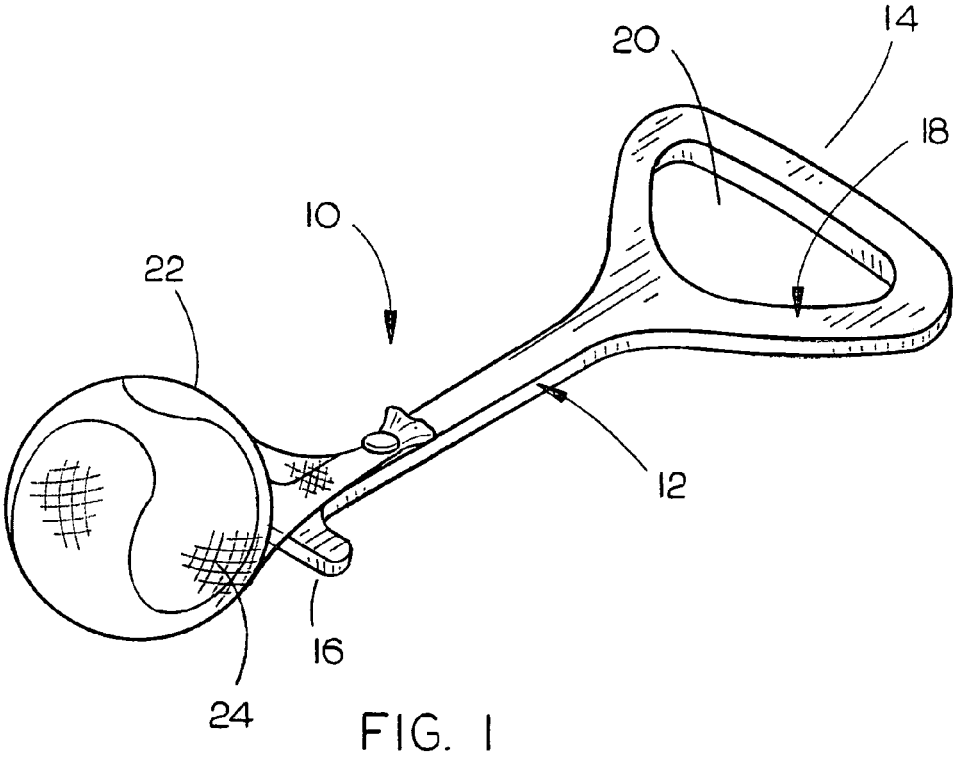
FIG. 1 is a perspective view of the massage device of this invention.
Figure 2:
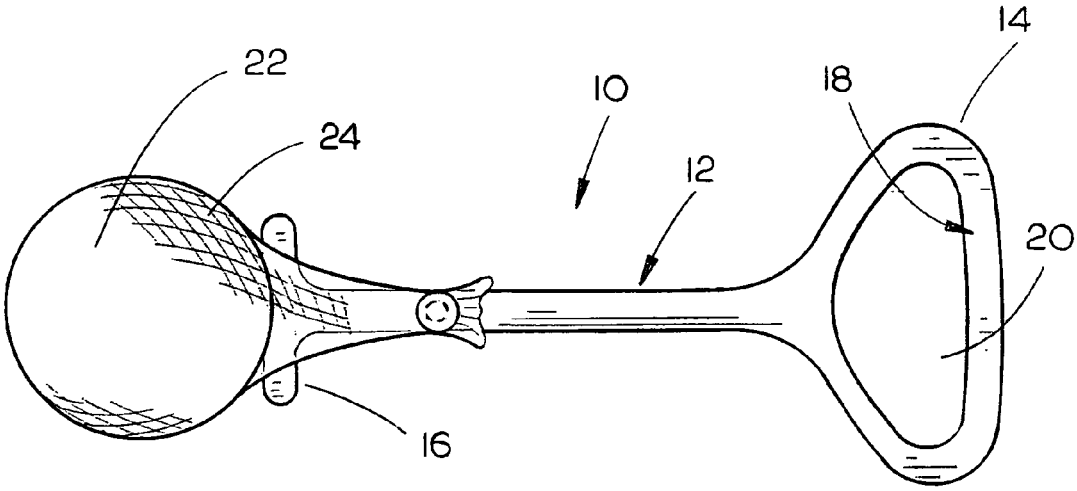
FIG. 2 is plan view of the massage device of this invention.

The massage device of this invention is generally indicated by the reference numeral 10. Device 10 includes an elongated flexible handle 12 preferably constructed of a plastic material.

Handle 12 includes ends 14 and 16 with end 14 including a hand-gripping portion 18 having an opening 20 formed thereon adapted to receive the fingers of a person utilizing the device.

The numeral 22 refers to a resilient ball, preferably a tennis ball, which is attached to end 16 in a manner such that the ball may move with respect to handle 12. In the preferred embodiment, a net material 24 extends around the ball 22 with the net material being secured to end 16 by any convenient means such as by glue or the like.

In use, if a person experiences back or shoulder pain, the person will first sit in a high-back chair and will grip the hand-gripping portion 18 of the handle 12 so that the device 10 may be maneuvered or manipulated into position wherein the ball 22 is located adjacent the area of back or shoulder pain. The person then leans backwards against the chair back so that the resilient ball 22 is positioned between the chair back and the person's back or shoulder. The person then moves from side to side and upwardly and downwardly with respect to the chair which causes the person's shoulder or back to move with respect to the resilient rolling ball, thereby creating a massaging effect to the area of back or shoulder pain.

The massage device 10 is easily transportable and may be carried in a purse, handbag or briefcase. The device is easy to use and the construction of the same ensures that the device will be comfortable to use.

Thus it can be seen that the invention accomplishes at least all of its stated objectives.

The invention claimed is:

1. The method of massaging a person's back who is sitting in a high-back chair, comprising the steps of:

providing a massage device including an elongated one-piece handle having first and second ends with only a single resilient ball at said second end thereof and only a hand-gripping portion at said first end thereof which is integrally formed with said handle;

grasping the first end of the handle and positioning the ball between the person's back and the high-back chair;

moving with respect to the ball thereby creating a massaging effect to a portion of the person's back.

2. The method of claim 1 wherein said handle is flexible.

3. The method of claim 2 wherein said handle is comprised of a plastic material.

4. The method of claim 1 wherein said first end of said handle has a hand-gripping portion thereon.

5. The method of claim 4 wherein said hand-gripping portion includes an opening adapted to receive fingers therein.

6. The method of claim 4 wherein said hand-gripping portion is generally V-shaped.

7. The method of claim 1 wherein said ball comprises a tennis ball.

8. The method of claim 1 wherein said ball is movably mounted on said second end of said handle.

9. The method of claim 1 wherein said handle is generally flat.

10. The method of massaging a person's back who is sitting in a high-back chair, comprising the steps of:

providing a massage device including an elongated handle having first and second ends and a resilient ball secured to the second end thereof by a net material extending around said resilient ball;

grasping the first end of the handle and positioning the ball between the person's back and the high-back chair;

moving with respect to the ball thereby creating a massaging effect to a portion of the person's back.

* * * * *